US011130214B2

(12) United States Patent
Bogorochaner et al.

(10) Patent No.: US 11,130,214 B2
(45) Date of Patent: Sep. 28, 2021

(54) SCREW DRIVER AND HEAD THEREFOR

(71) Applicants: Artur Bogorochaner, Beer Yaacov (IL); Yitshak Blinder, Ashdod (IL)

(72) Inventors: Artur Bogorochaner, Beer Yaacov (IL); Yitshak Blinder, Ashdod (IL)

( * ) Notice: Subject to any disclaimer, the term of this patent is extended or adjusted under 35 U.S.C. 154(b) by 233 days.

(21) Appl. No.: 16/603,659

(22) PCT Filed: Apr. 4, 2018

(86) PCT No.: PCT/IL2018/050400
§ 371 (c)(1),
(2) Date: Oct. 8, 2019

(87) PCT Pub. No.: WO2018/189739
PCT Pub. Date: Oct. 18, 2018

(65) Prior Publication Data

US 2020/0130149 A1 Apr. 30, 2020

(30) Foreign Application Priority Data

Apr. 9, 2017 (IL) ..... 251776

(51) Int. Cl.

| | |
|---|---|
| ***B25B 15/00*** | (2006.01) |
| ***B25B 23/00*** | (2006.01) |
| ***B25B 13/50*** | (2006.01) |
| ***B25B 13/48*** | (2006.01) |

(52) U.S. Cl.
CPC ..... *B25B 15/004* (2013.01); *B25B 13/481* (2013.01); *B25B 13/50* (2013.01); *B25B 23/0035* (2013.01)

(58) Field of Classification Search
CPC ..... B25B 15/00; B25B 15/001; B25B 15/004; B25B 13/481; B25B 13/50; B25B 23/0007; B25B 23/0035
See application file for complete search history.

(56) References Cited

U.S. PATENT DOCUMENTS

| | | | | |
|---|---|---|---|---|
| 4,526,069 | A | 7/1985 | Cecil | |
| 5,967,002 | A | 10/1999 | Pijanowski | |
| 10,124,473 | B2 * | 11/2018 | Wang | B25B 23/12 |
| 2014/0260832 | A1 * | 9/2014 | Hsiao | B25B 15/001 81/438 |
| 2016/0176028 | A1 * | 6/2016 | Doggett | B25B 15/001 81/438 |

* cited by examiner

*Primary Examiner* — David B. Thomas
(74) *Attorney, Agent, or Firm* — Browdy and Neimark, PLLC

(57) ABSTRACT

A screw head adapter, including a surrounding shaped envelope, being hex, square, etc., being adaptable to a standard key, ring, box wrench, including at its center, a bit, a flat-blade screwdriver, a Phillips screwdriver, hex, Allen wrench, having an adjustable or constant height, for connecting thereof to a standard key, box wrench, dedicated key, etc., adapted thereto and supported by a dedicated protrusion, being fastened to the box wrench by a mechanical, magnetic, etc. attaching means, for allowing, due to its short height, to easily open or close screw heads in narrow hidden regions, and to those having difficult or non-available access by other tools.

5 Claims, 7 Drawing Sheets

FIG 1 - PRIOR ART

SCREW DRIVER AND HEAD THEREFOR

TECHNICAL FIELD

The invention relates to the field of screw drivers. More particularly, the invention relates to a reduced screw driver and to a head.

BACKGROUND

FIG. 1 depicts a prior art wrench, and the problem regarding the use thereof.

A prior art wrench 72 is shown embracing a prior art tip 18A, being a screwdriver head element, for rotating a screw head 16.

However, the overall thickness 64A of prior art wrench 72 together with prior art tip 18A is too large. FIG. 1 shows a case that the distance between a wall 12 and the hung element 14, between which screw head 16 is disposed, is sufficiently large for inserting tip 18A only, but is too small for inserting prior art wrench 72.

There is a long felt need to provide a solution to the above-mentioned and other problems of the prior art.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 2:
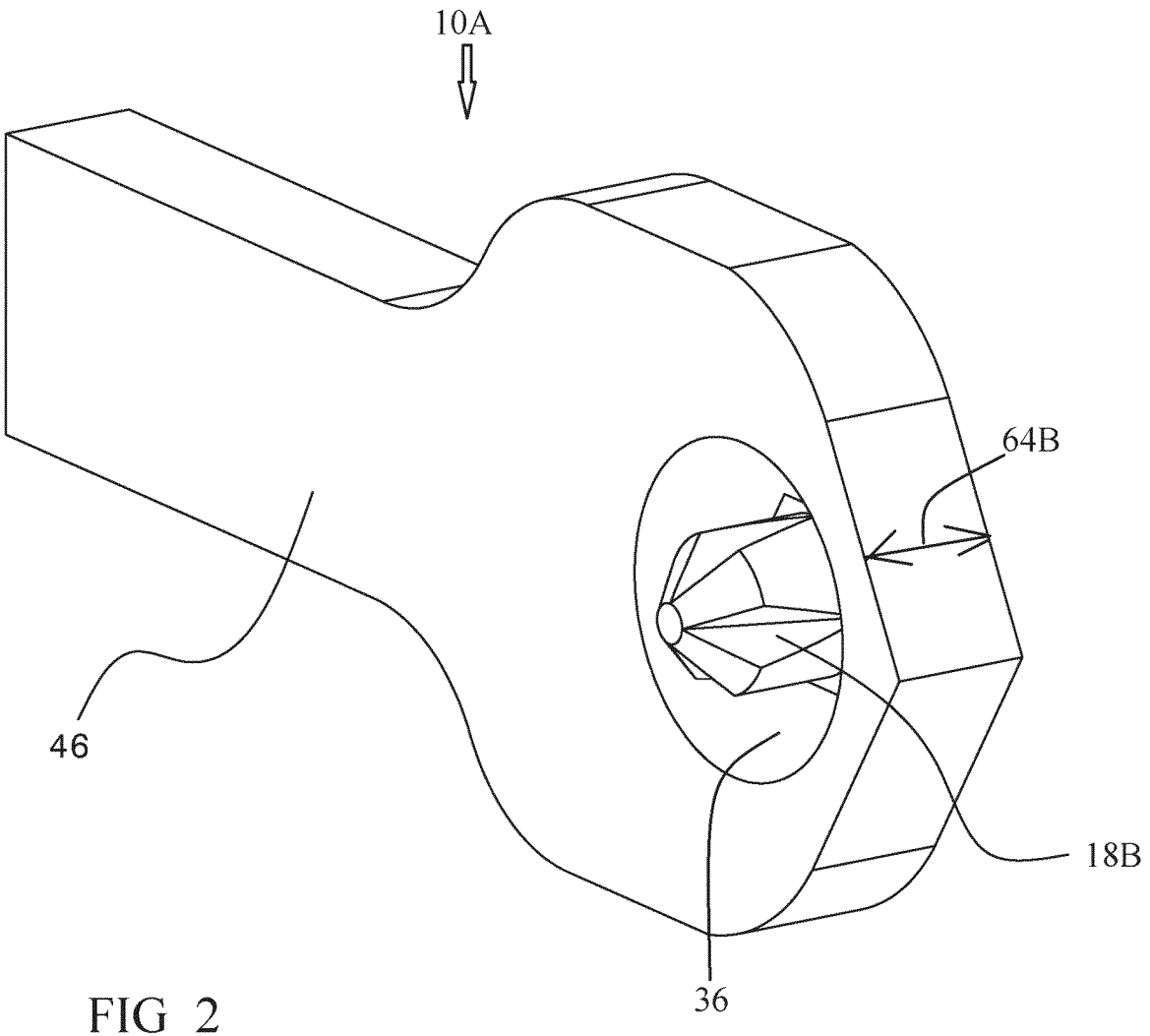
FIG. 2 is a perspective view of a screw driver according to one embodiment of the invention.

FIG. 2 is a perspective view of a screw driver according to one embodiment of the invention.

A screw driver 10A according to one embodiment of the invention, includes a wrench handle 46; a niche 36 disposed at the end of wrench handle 46; and a tip 18B, being housed within niche 36, such that wrench handle 46, niche 36, and tip 18B occupy a shared thickness 64B, being the overall thickness.

Figure 3:
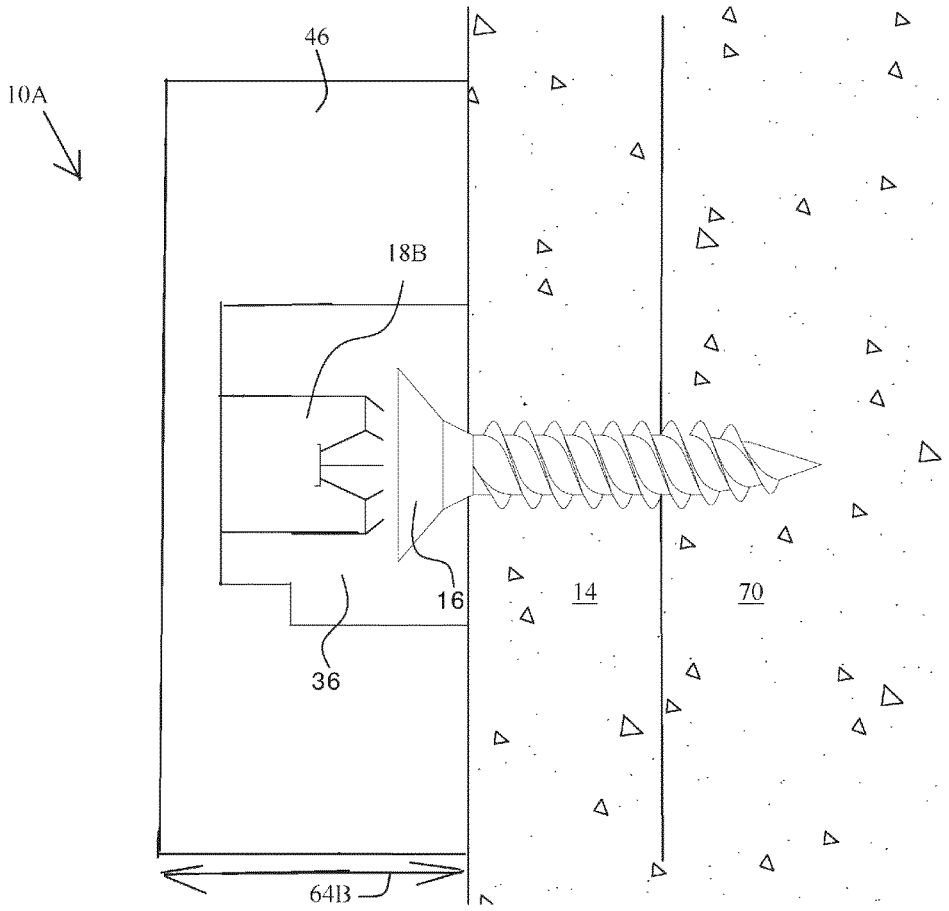
FIG. 3 is a side view of the screw driver of FIG. 2 at operation.

FIG. 3 is a side view of the screw driver of FIG. 2 at operation.

Tip 18B includes a screwdriver head or a nut-driver head of any available type, and thus is configured and shaped complementary to a screw head 16, for being inserted thereinto, or for embracing a nut (not shown).

Thus, in addition to wrench handle 46, to niche 36, and to tip 18B, screw head 16 as well occupies said shared thickness 64B.

Figure 1:
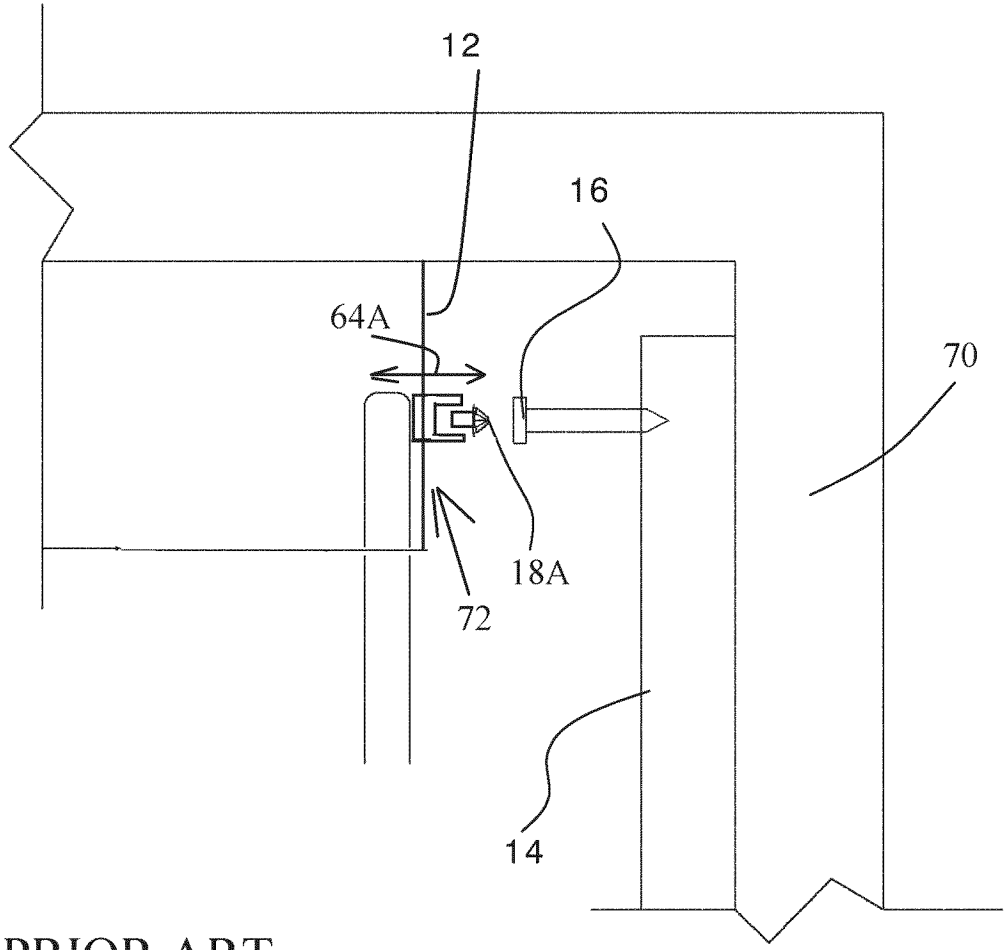
FIG. 1 depicts a prior art wrench, and the problem regarding the use thereof.
Figure 4:
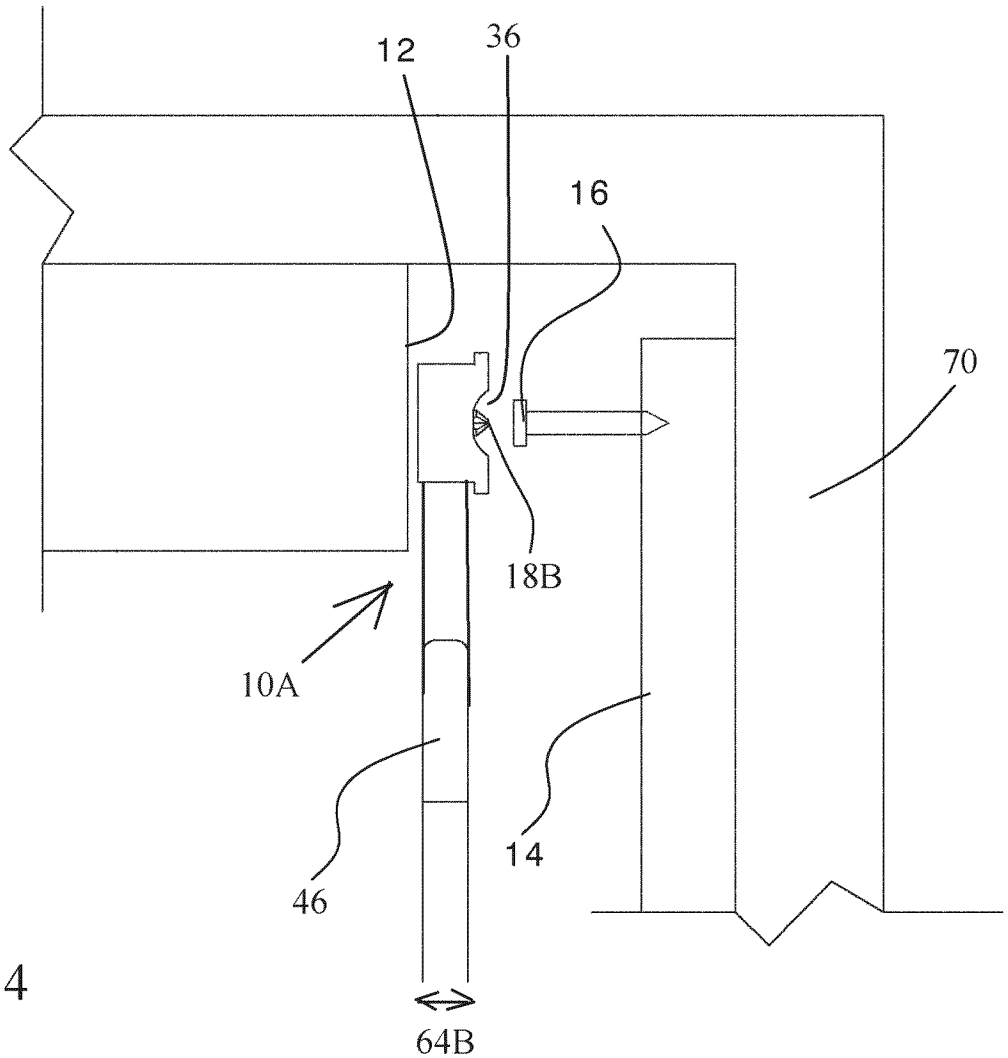
FIG. 4 is a schematic side view of the screw driver of FIG. 1 and that it solves the problem of FIG. 1.

FIG. 4 is a schematic side view of the screw driver of FIG. 1 and that it solves the problem of FIG. 1.

Unlike FIG. 1, since here wrench handle 46, niche 36, and tip 18B, all of screw driver 10A, and as well screw head 16, all occupy said shared thickness 64B, screw driver 10A is insertable between wall 12 and hung element 14.

Figure 5:
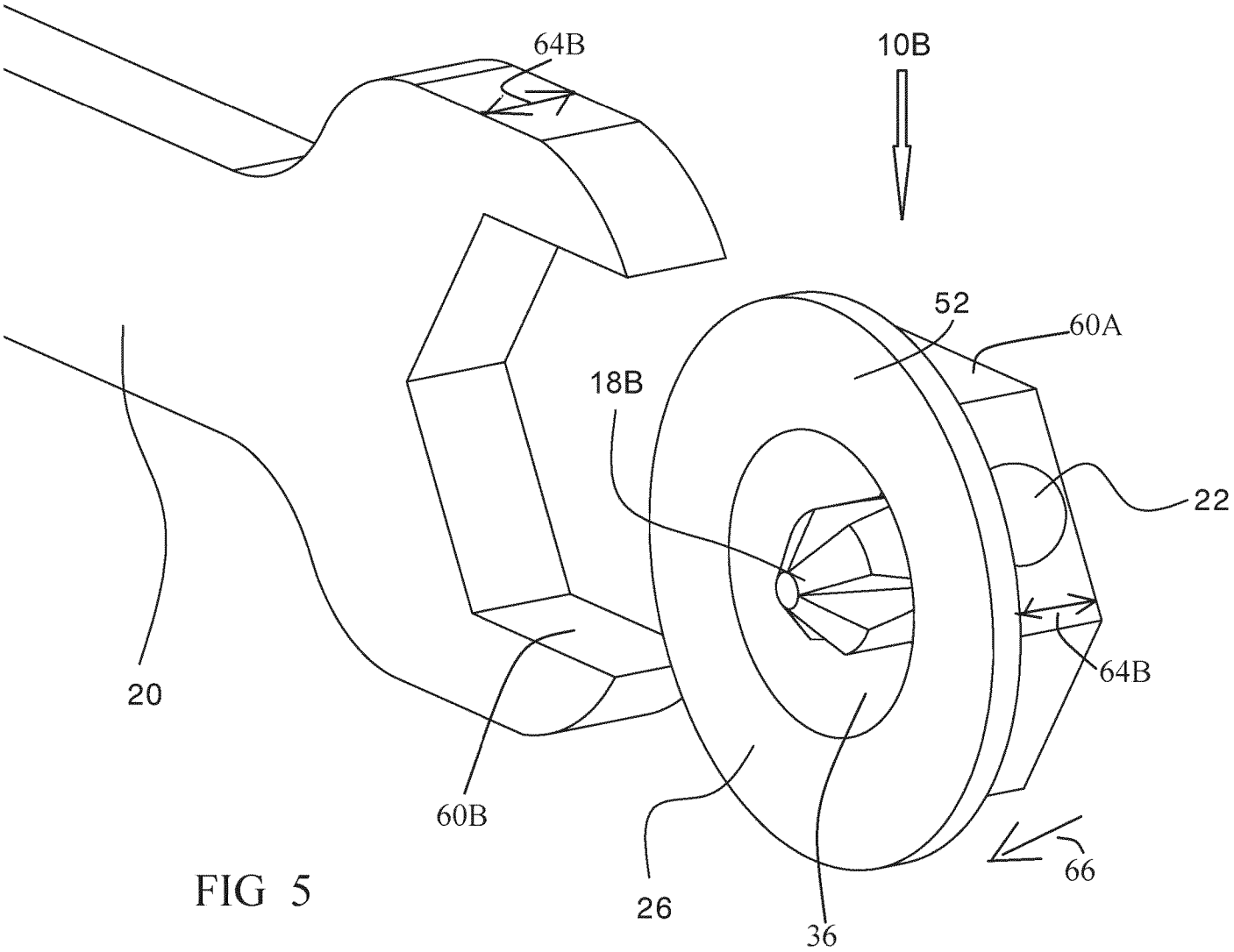
FIG. 5 is a perspective view of a screwdriver head according to one embodiment of the invention, being similar to the head of the screw driver of FIG. 1: and a handle for turning the screwdriver head.

FIG. 5 is a perspective view of a screwdriver head according to one embodiment of the invention, being similar to the head of the screw driver of FIG. 1; and a handle for turning the screwdriver head.

A screw driver head 10B according to one embodiment of the invention, includes an engaging head 60A, for engaging thereof to a complementary engaging head 60B of a wrench 20; a niche 36 being a niche in engaging head 60A; and tip 18B, being housed within niche 36, such that engaging head 60A, niche 36, tip 18B, and engaging head 60B of wrench 20 occupy the shared thickness 64B.

Screw driver head 10B may further include a peripheral extension 26, extending from engaging head 60A, for pressing thereof to the direction of arrow 66 towards the wall, by engaging head 60B of wrench 20.

Figure 6:
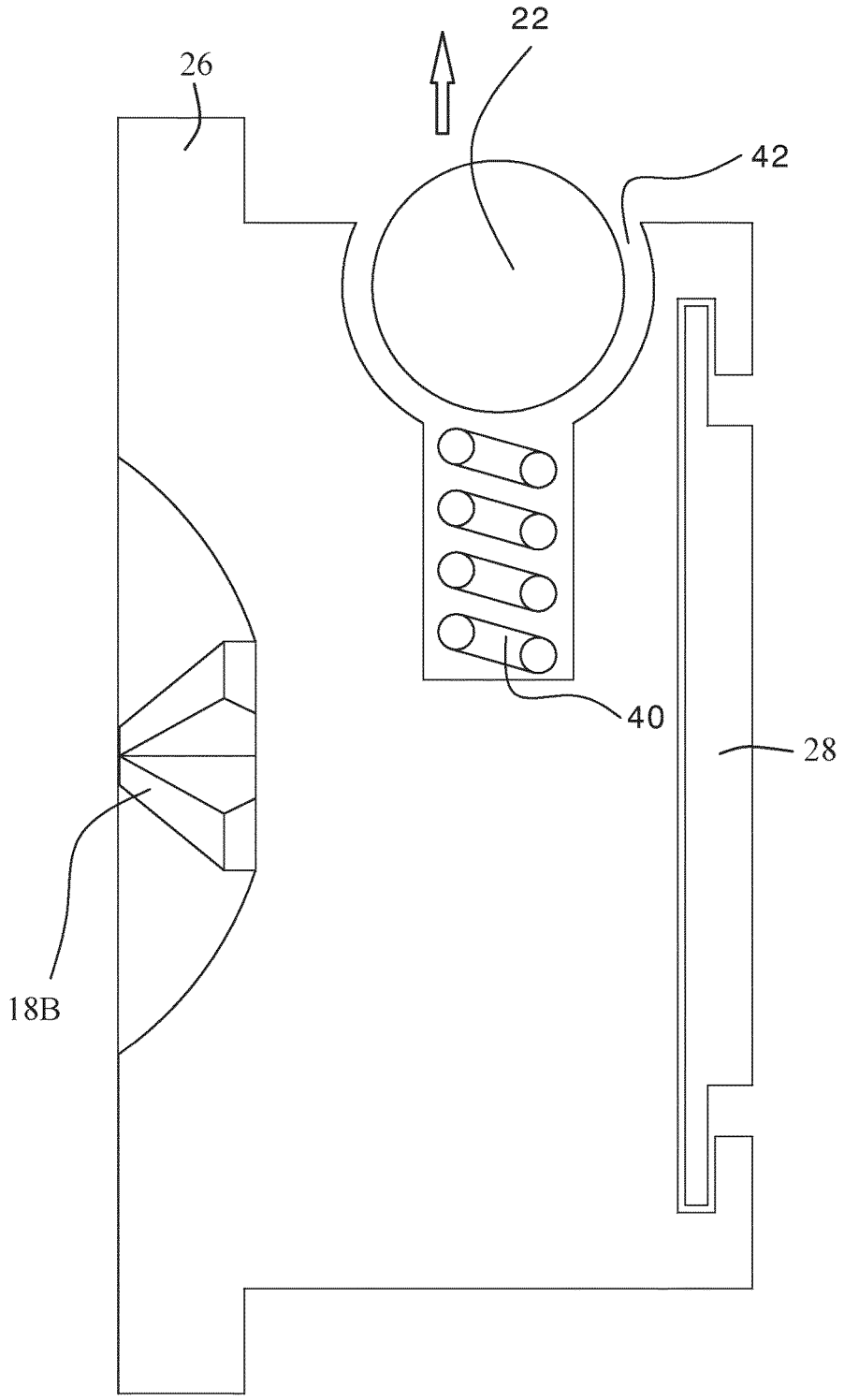
FIG. 6 is a side schematic view of the screwdriver head of FIG. 5.

FIG. 6 is a side schematic view of the screwdriver head of FIG. 5.

Screw driver head 10B may further include an attaching element 22, for attaching screw driver head 10B to engaging head 60B of wrench 20. Attaching element 22 may constitute a springy pressing element, for pressing thereof towards engaging head 60B of wrench 20 (of FIG. 5). According to another embodiment, attaching element 22 may constitute a magnet.

Figure 7:
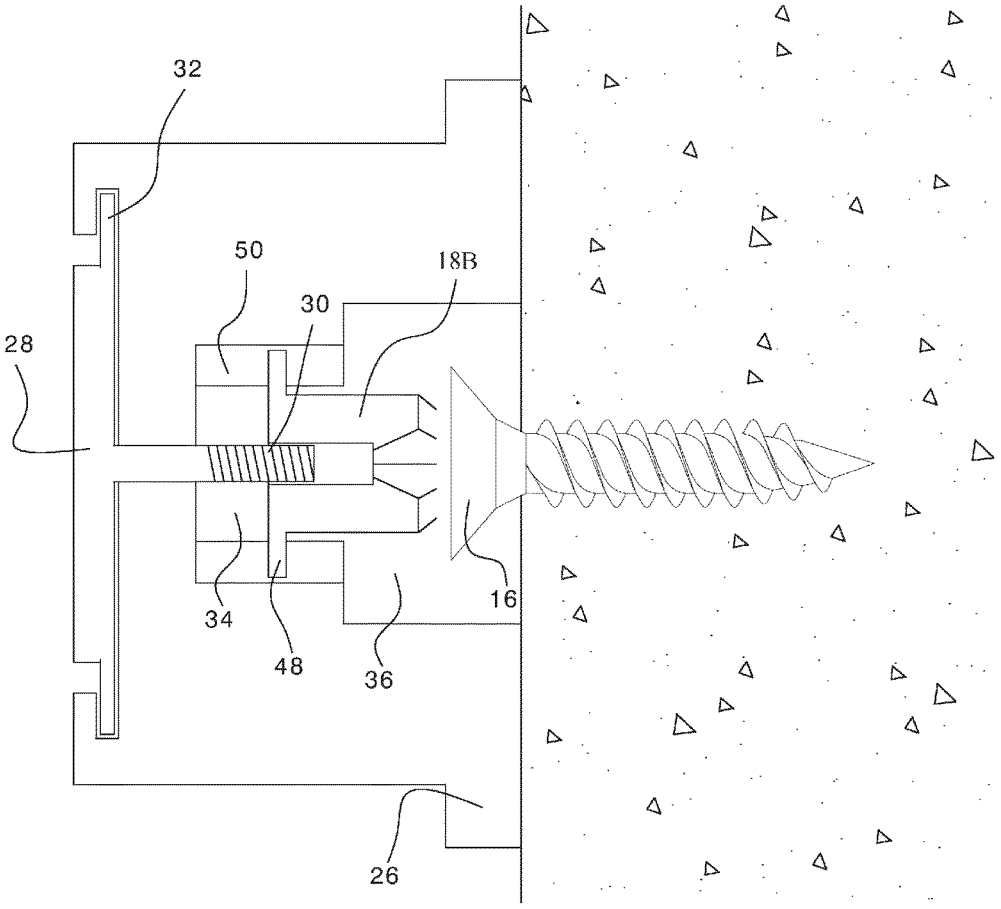
FIG. 7 depicts the screw driver head of FIG. 5, joining the screw head of FIG. 1, and having a location adjusting mechanism.

FIG. 7 depicts the screw driver head of FIG. 5, joining the screw head of FIG. 1, and having a location adjusting mechanism.

Screw driver head 10B may further include a thread 30, extending from a user-operable handle 28, for sliding tip 18B in relation to niche 36. Tip 18B is not rotatable in relation to niche 36.

Thus, in one aspect, the invention is directed to a screw driver head (10B), including:

- a main engaging head (60A), for engaging thereof to a complementary engaging head (60B) of a wrench (20);
- a niche (36), including a niche in the main engaging head (60A): and
- a tip (18B) being shaped complementary to a screw head (16) for rotating thereof, the tip (18B) being housed within the niche (36),
- thereby the main engaging head (60A), the complementary engaging head (60B) of the wrench (20), the niche (36), and the tip (18B) all occupy a shared thickness (64B), thereby diminishing it.

The screw driver head (10B) may further include:

- a peripheral extension (26), extending from the engaging head (60A), for pressing thereof, by the engaging head (60B) of the wrench (20), towards (66) the wall (12), for attaching the screw head (16) thereto.

The screw driver head (10B) may further include:

a pressing element (22), for pressing thereof by the engaging head (60B) of the wrench (20).

The screw driver head (10B) may further include:

a thread (30), extending from a user-operable handle (28), for allowing sliding the tip (18B) in relation to the niche (36).

In another aspect, the invention is directed to a screw driver (10A), including:

a wrench handle (46);

a niche (36) disposed at an end of the wrench handle (46); and a tip (18B) being shaped complementary to a screw head (16) for rotating thereof, the tip (18B) being housed within the niche (36), thereby the wrench handle (46), the niche (36), and the tip (18B) occupy a shared thickness (64B), thereby reducing the overall thickness of the wrench handle (46) with that of the tip (18B).

In the figures and/or description herein, the following reference numerals (Reference Signs List) have been mentioned:

numeral 10A denotes a screw driver according to one embodiment of the invention;

numeral 10B denotes a screw driver head according to one embodiment of the invention;

numeral 12 a wall;

numeral 14 denotes an element attached/hung to the wall numeral 16 denotes a head of a screw or of a nut;

numeral 18A denotes the prior art tip;

numeral 18B denotes the inventive tip;

numeral 20 denotes a wrench for rotating the inventive screw driver head;

numeral 22 denotes a pressing element, such as a ball;

numeral 26 denotes the peripheral extension extending from the engaging head of the inventive screw driver head;

numeral 28 denotes the user-operable handle, for sliding the tip;

numeral 32 denotes a wall for not allowing removal of the user-operable handle;

numeral 34 denotes a cylinder for sliding the tip therewithin;

numeral 36 denotes the niche, housing the tip;

numeral 40 denotes a spring;

numeral 42 denotes a cell, for housing the spring and the pressing element;

numeral 46 denotes the wrench handle;

numeral 48 denotes a non-peripheral protrusion extending from the tip, for sliding within niche 50;

numeral 50 denotes a non-peripheral slit, for not allowing rotation of the tip in relation to niche 50;

numeral 60A denotes an engaging head of the inventive screw driver;

numeral 60B denotes an engaging head of a wrench;

numeral 64A denotes the overall thickness of the prior art wrench together with the prior art tip;

numeral 64B denotes the thickness of the inventive wrench; and as well the thickness of the inventive tip; and as well the overall thickness of the wrench together with the tip of the invention;

numeral 66 denotes the direction of pressing the screw towards the wall;

numeral 70 denotes a wall; and numeral 72 denotes the prior art wrench.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A screw driver head (10B), comprising:

a main engaging head (60A), for engaging thereof to a complementary engaging head (60B) of a wrench (20);

a niche (36), comprising a niche in said main engaging head (60A); and a tip (18B) being shaped complementary to a screw head (16) for rotating thereof, said tip (18B) being housed within said niche (36), thereby said main engaging head (60A), said complementary engaging head (60B) of said wrench (20), said niche (36), and said tip (18B) all occupy a shared thickness (64B), thereby diminishing it.

2. A screw driver head (10B) according to claim 1, further comprising:

a peripheral extension (26), extending from said engaging head (60A), for pressing thereof, by said engaging head (60B) of said wrench (20), towards (66) a wall (12), for attaching said screw head (16) thereto.

3. A screw driver head (10B) according to claim 1, further comprising:

an attaching element (22), for attaching said screw driver head (10B) to said engaging head (60B) of said wrench (20).

4. A screw driver head (10B) according to claim 1, further comprising:

a thread (30), extending from a user-operable handle (28), for allowing sliding said tip (18B) in relation to said niche (36).

5. A screw driver (10A), comprising:

a wrench handle (46);

a niche (36) disposed at an end of said wrench handle (46); and a tip (18B) being shaped complementary to a screw head (16) for rotating thereof, said tip (18B) being housed within said niche (36), thereby said wrench handle (46), said niche (36), and said tip (18B) occupy a shared thickness (64B), thereby reducing an overall thickness of said wrench handle (46) with that of said tip (18B).

* * * * *